United States Patent [19]

Pitcher, Jr.

[11] Patent Number: 4,721,298

[45] Date of Patent: Jan. 26, 1988

[54] BI-STABLE PAPER SEPARATOR

[75] Inventor: Edgar R. Pitcher, Jr., Dallas, Tex.

[73] Assignee: Light Signatures, Inc., Los Angeles, Calif.

[21] Appl. No.: 901,711

[22] Filed: Aug. 29, 1986

[51] Int. Cl.[4] ..... B65H 39/10

[52] U.S. Cl. ..... 271/303

[58] Field of Search ..... 271/297, 303, 305

[56] References Cited

U.S. PATENT DOCUMENTS

| | | | |
|---|---|---|---|
| 1,784,855 | 12/1930 | Tufts | 271/303 |
| 2,668,483 | 2/1954 | Sykes | 271/303 X |
| 3,252,570 | 5/1966 | Smith | 271/305 |
| 4,518,161 | 5/1985 | Nakamura | 271/303 |

FOREIGN PATENT DOCUMENTS

| | | | |
|---|---|---|---|
| 703347 | 2/1954 | United Kingdom | 271/303 |

*Primary Examiner*—Richard A. Schacher

*Attorney, Agent, or Firm*—Nilsson, Robbins, Dalgarn, Berliner, Carson & Wurst

[57] ABSTRACT

A separator for segregating alternate sheets of paper traveling in a sequential stream and directing them into different exit passages comprising a housing, a guide and a bi-stable apparatus. The housing defines an entry passage and a pair of exit passages. The guide is constructed for alternately deflecting the sheets in said stream into different exit passages. The bi-stable apparatus mounts the guide between the entry and exit passages of the housing so that the guide has two stable positions and the guide shifts between these positions in response to a sheet of paper passing by it into one of the exit passages. Sheets of paper enter the separator through the entry passage in the housing and are deflected by the guide into one of the two exit passages depending on the position of the guide at the time the sheet enters the separator. As individual sheets of paper travel past the guide and engage it, they cause it to shift to its other stable position. In its alternate position the guide deflects the next succeeding sheet of paper into the other exit passage. Thus, the guide cycles between two positions to direct alternate sheets in alternate directions.

7 Claims, 6 Drawing Figures

BI-STABLE PAPER SEPARATOR

BACKGROUND OF THE INVENTION

The present invention relates to sheet material handling devices and more particularly to mechanisms for directing successive sheets of paper traveling in a stream into different passages.

In the past, machines for directing sheets of paper into different passages have included wedge-shaped deflectors and control means for shifting the position of the deflectors in response to the movements of the sheets. The control means have generally comprised shaft-and-gear assemblies which adjust the orientation of the deflector when actuated by the sheets individually pushing a lever as they pass into one of the exit passages. Alternatively, electromechanical means, such as solenoids, have been employed to shift the deflector in response to electrical signals from photoelectric devices which sense the passing of sheets of paper.

The present invention provides an apparatus for alternately directing sheets of paper into different passages and does not require a separate control means for shifting the position of a deflector assembly and also does not require an external input to control such a deflector assembly. The present invention provides an apparatus which is, therefore, simpler, more reliable and less expensive than traditional paper separator devices.

SUMMARY OF THE INVENTION

The present invention constitutes a separator for segregating alternate sheets of paper traveling in a sequential stream and directing them into different exit passages. The separator comprises a housing, a guide and a bi-stable apparatus. The housing defines an entry passage and a pair of exit passages. The guide is constructed for alternately deflecting the sheets in said stream into different exit passages. The bi-stable apparatus mounts the guide between the entry and exit passages of the housing so that the guide has two stable positions and the guide shifts between these positions in response to a sheet of paper passing by it into one of the exit passages.

In the operation of a separator in accordance with the present invention, sheets of paper enter the separator through the entry passage in the housing and are deflected by the guide into one of the two exit passages depending on the position of the guide at the time the sheet enters the separator. As individual sheets of paper travel past the guide and engage it they cause it to shift to its other stable position. In its alternate position, the guide deflects the next succeeding sheet of paper into the other exit passage. Thus, the guide cycles between two positions to direct alternate sheets in alternate directions.

DESCRIPTION OF THE PREFERRED EMBODIMENT

Figure 1:
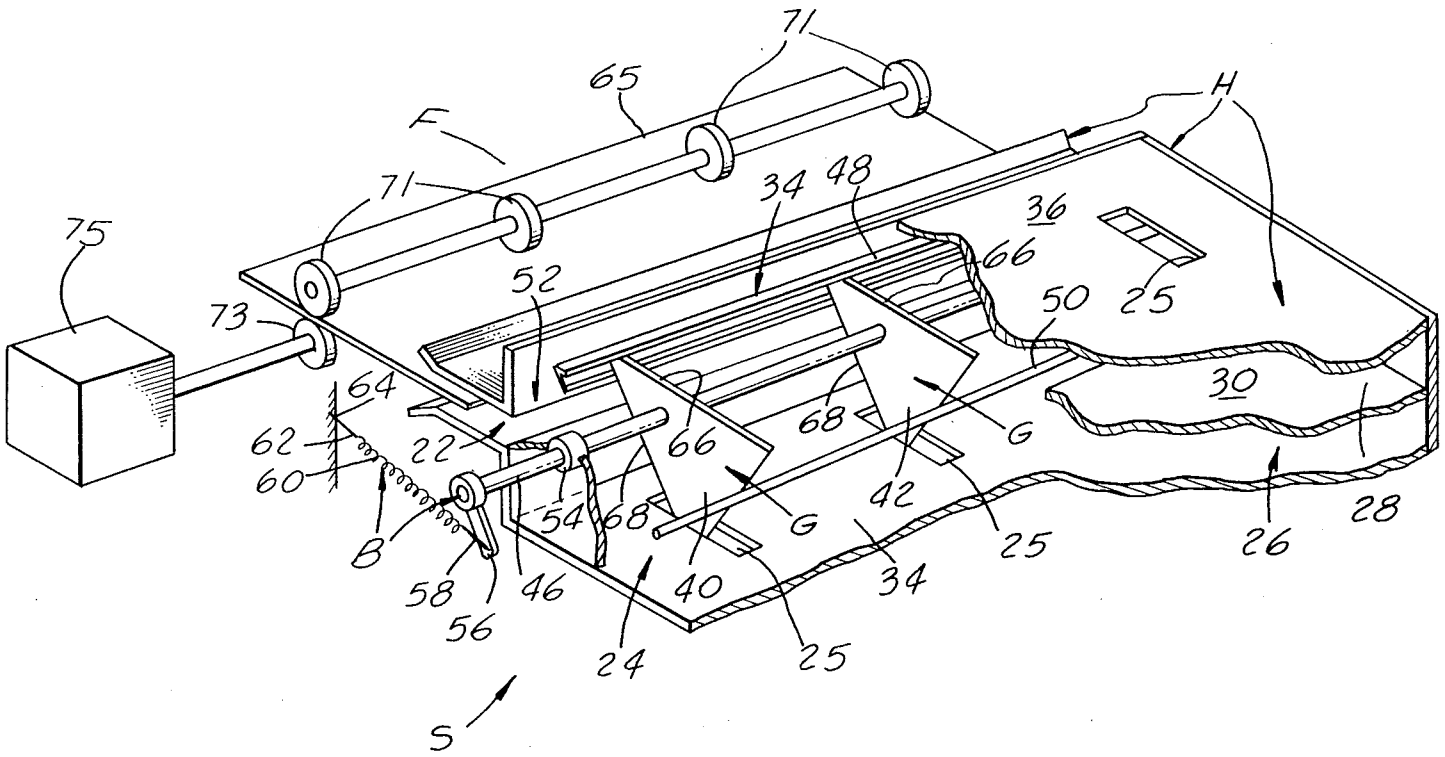
FIG. 1 is a perspective view of the disclosed embodiment of the present invention with the housing partially broken away.

Referring now to FIG. 1, the present invention a separator S having a housing H for providing entry and is illustrated as exit passages, a guide means G for deflecting paper sheets and a bi-stable mechanism or means B for mounting the guide means G.

The housing H defines an entry passage 22 (center left) for constraining the movements of sheets of paper as they enter the separator S. The passage 22 enters an enlarged central plenum 24 in which the guide means G is located and for which there are two separate exit passages 26 and 28. The plenum 24 defines elongate, upper and lower slots 25 which allow part of the guide means G to project out from the plenum and thereby provide the guide means G with a greater range of action, as will be further explained below.

The exit passages 26 and 28 (FIG. 1, right) are parallel, separated only by the common wall 30. The exit passages 26 and 28 are located opposite the entry passage 22 across the plenum 24 so that an extension of the plane of the wall 30 would bisect the entry passage 22 and so that the individual exit passages 26 and 28 are offset from the tranverse center of the separator S represented by the planar center of the entry passage 22.

Figure 2:
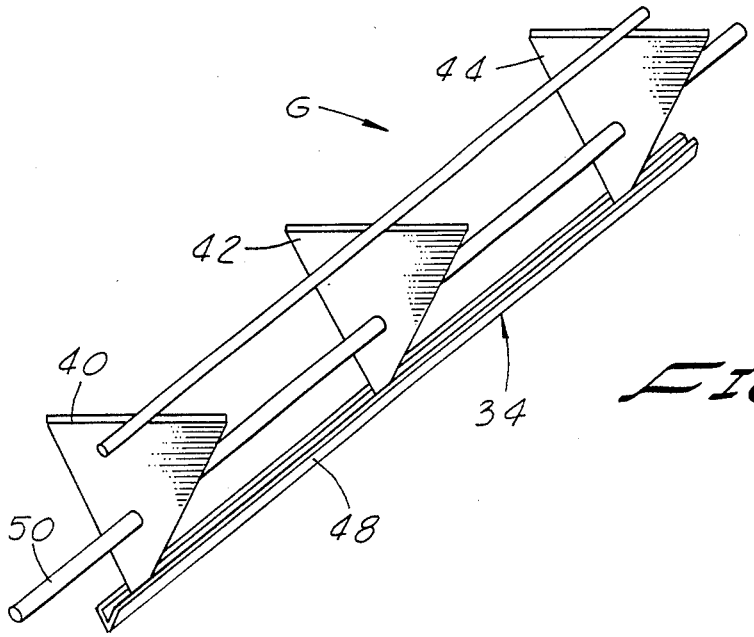
FIG. 2 is a perspective view of the guide means component of the present invention.
Figure 3A:
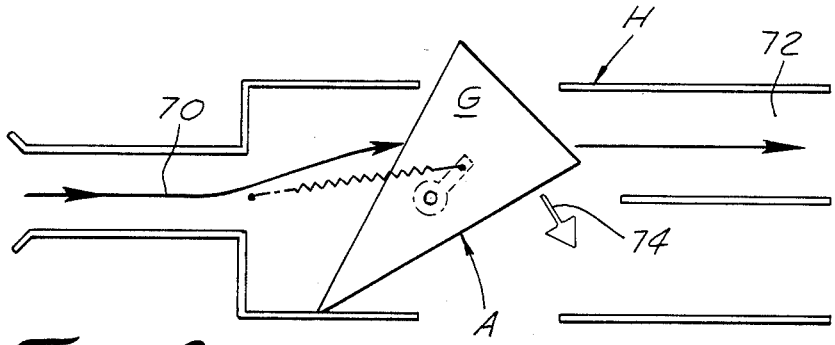
FIGS. 3*a* and 3*b* are diagrammatic cross-sectional views of the present invention illustrating its operation.
Figure 3B:
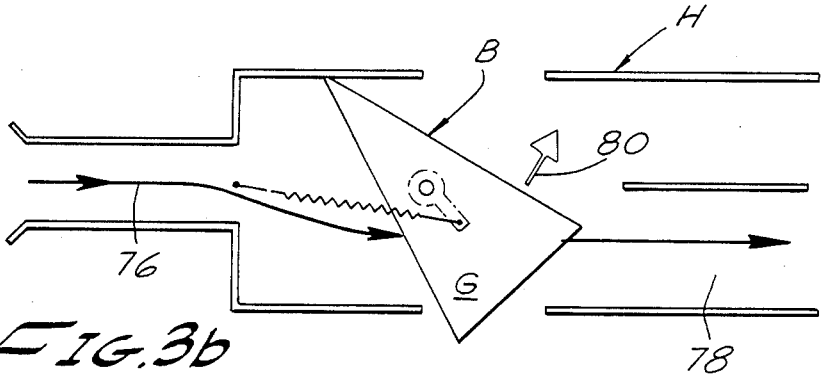

The guide means G constitutes a wedge-shaped deflector assembly designed to be of lightweight construction. As shown in FIG. 2, the guide means G includes a set of three thin, identical, rigid triangular plates 40, 42 and 44 mounted in parallel alignment on a single axle 46 which comprises part of the bi-stable means B. The plates 40, 42 and 44 comprise three similarly oriented isosceles triangles which are fixed parallel to each other, are orthogonal to the axle 46 and are equally spaced apart along the axle.

Elongate strips 48 and 50 of reinforcing material extend parallel to the axle 46 and are secured to the edges of the plates 40, 42 and 44 for maintaining the rigidity, alignment and balance of the guide means G. Specifically, the channel strip 48 is matingly affixed to the leading apexes of the plates 40, 42 and 44 to define a front edge 34. The rod strip 50 is affixed at opposed locations on the bases of the same triangular plates.

Referring now again to FIG. 1, the guide means G is mounted in the center of the plenum 24 between the entry passage 22 and the exit passages 26 and 28 with the front edge 34 of the wedge-shaped form of the guide means G facing toward the entry passage 22. The axle 46 runs parallel to the back end 52 of the entry passage 22 and lies within the plane representing the transverse center of the separator S.

The bi-stable means B mounts guide means G. The axle 46 is mounted in spaced apart bearings 54 and 57 (not shown) which allow the guide means G to pivot between stable positions in the plenum 24. The guide means G pivots within a limited arc determined by the opposed points of contact of the plates 40, 42 and 44 with the walls 36 of plenum 24 as the plates project through slots 25 in each wall. The end of the axle 46 is connected to an arm 56 which extends at right angles from the axle and is attached to the end 58 of a spring 60. The opposite end 62 of the spring 60 is attached to a point 64, fixed with respect to the housing H. The point 64 is located across the axle from the center of the pivotal range of the arm 56 (as governed by the pivotal range of the guide means G).

In operation, the spring 60 continuously tensions the arm 56 and biases the arm toward the two limits of its pivotal range at which points the arm 56, the axle 46 and the guide means G attached thereto assume stable positions. The mounting for the guide means G within the housing H accomplishes a bi-stable arrangement in which the guide means may swing between two stable positions.

The separator as described generally may be produced of sheet metal using conventional methods and machines. The guide means G may be formed as a subassembly with linear and sheet stock through the use of standard welding techniques. The guide means G may be mounted as illustrated in the housing H, the combination then being fitted with completing component parts.

To further explain the illustrative embodiment, the operation will now be described along with other components of the unit. Accordingly, assume sheets of paper, or other sheets of paper-like materials are continuously supplied by a feeding mechanism F to the separator S. As shown in FIG. 1, opposed sets of engaging feed rollers 71 and 73 are rotated by the power unit 75 to provide a sequential stream of individual sheets to the entry passage 22, such as sheet 65. The sheets travel through the entry passage 22 into the plenum 24 where they strike one of the front-facing sets 66 or 68 of parallel edges of the plates 40, 42 and 44 of the guide means G.

The set 66 or 68 contacted by a sheet depends on the stable position of the guide means G when the sheet enters the plenum 24. Accordingly, the guide means G directs the received sheet toward one or the other of the two exit passages 26 or 28.

Each sheet of paper received exerts a rotational force on the guide means G as it passes to one of the exit passages 26 and 28. The force causes the guide means G to pivot toward and assume its other alternative bi-stable position. From its alternate position, the guide means G directs the next sheet of paper into the other exit passages 26 or 28.

The slots 25 in the plenum 24 allow a greater pivotal range for the guide means G by accommodating the plates 40, 42 and 44 to project from the plenum 24. This construction provides for more sustained contact between the sheets and the guide means G, which allows for a greater transfer of force between the sheets of paper and the guide means G as each sheet passes by the guide means. The guide means G repetitively shifts position thereby directing alternate sheets in the sequential stream entering the separator S into different exit passages.

The action of the guide means G is illustrated in FIGS. *3a* and *3b*. When the guide means G is in stable position A, as shown in FIG. *3a*, it directs sheets along path 70 into exit passage 72. Each sheet exerts a force on the guide means G which causes it to pivot in the direction indicated by an arrow 74 and assume its alternate position B as shown in FIG. *3b*. When the guide means G is in position B, it directs sheets along path 76 into exit passage 78. Each sheet exerts a force on the guide means G which causes it to pivot in the direction indicated by an arrow 80 and assume its other position A as shown in FIG. *3a*. Thus, a characteristic feature of the structure is that a passing sheet flips the guide means from one stable position to the other.

Figure 4:
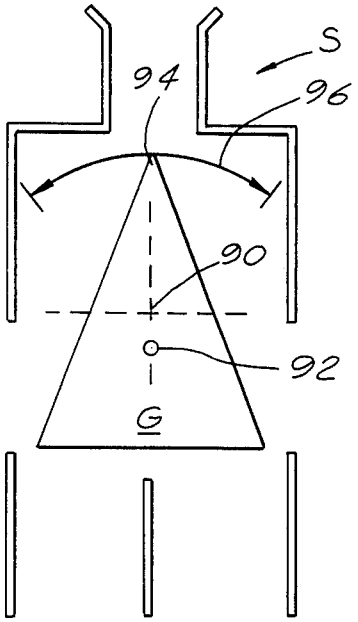
FIG. 4 is a diagrammatic side view of a guide means element of the present invention.

Referring now to FIG. 4, the bi-stable means of the present invention may be alternately constructed by carefully adjusting the position of the center of gravity 90 of the guide means G with respect to its pivotal axis 92. The center of gravity 90 is positioned to be directly above the axis 92 when the guide means G is at the center of its pivotal range and the front edge 94 of the wedge-shaped form of the guide means is coincident with the transverse planar center of the separator S. The force of gravity will then act upon the guide means G to bias it towards the two stable limits of its pivotal range 96, at which points the guide means assumes stable positions.

Figure 5:
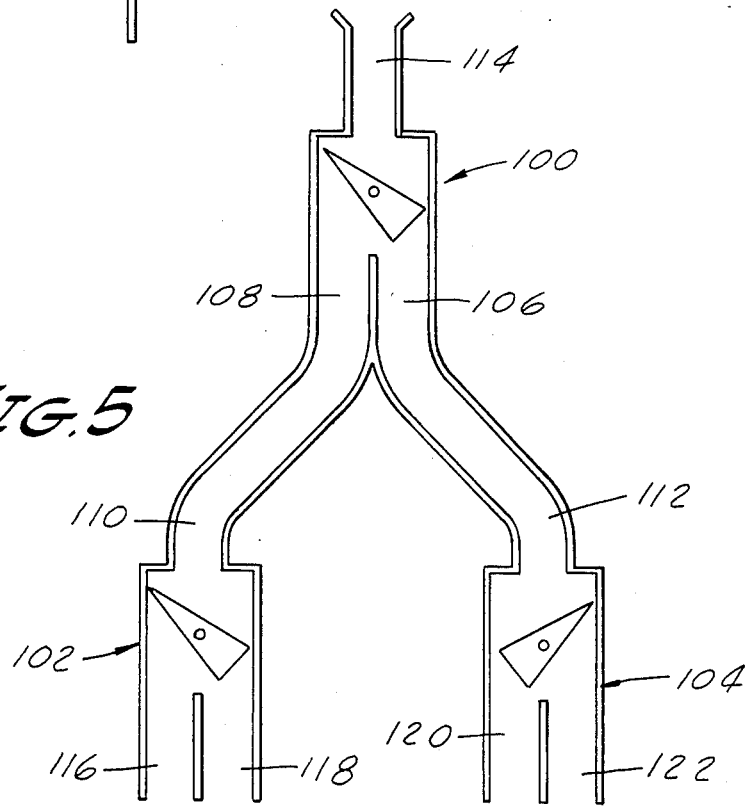
FIG. 5 is a diagrammatic side view of three units of the present invention installed in series.

Referring now to FIG. 5, individual separator units 100, 102 and 104 of the present invention as described above may be installed in series as shown for sorting papers into more than two classes. The separator units 100, 102 and 104 include entry passages 114, 110 and 112, respectively, and also include exit passages 106 and 108, 116 and 118 and 120 and 122, respectively. The exit passages 106 and 108 of the unit 100 are connected to the entry passages 110 and 112 of the units 102 and 104. Sheets of paper entering at the entry passage 114 of the unit 100 may thereby be segregated and directed into different exit passages 116, 118, 120 and 122.

While the system of this invention has been described in conjunction with particular embodiments, it should be apparent that certain changes could be made without departing from the principles of the invention. Consequently, the embodiments provided are intended to be illustrative only and are not meant to limit the scope of the following claims.

I claim:

1. A separator for segregating alternate individual sheets of paper for example in a sequential stream into two separate streams, comprising:

a housing defining an entry passage for said sequential stream of sheets and further defining a pair of separate offset exit passages;

guide means mounted in said housing for selectively deflecting said sheets in said sequential stream of said entry passage alternately into a different one of said exit passages; and bi-stable means for mounting said guide means in said housing between said entry passage and said exit passages so that said guide means may assume either one of two stable positions, each for directing said sheets into said different exit passages, said guide means, said bi-stable means and said housing means being constructed and arranged whereby said guide means is acturated to shift between said stable positions by the force exerted on said guide means by the passage of each individual sheet as said sheet passes said guide means into one of said exit passages.

2. The separator of claim 1, wherein said bi-stable means comprises an axle mounted in bearings so that said guide means may pivot and biasing means for biasing said guide means to the limits of a pivotal range.

3. The separator of claim 2, wherein said biasing means comprises an arm attached to said axle and a spring attached to said arm and attached to a point fixed with respect to said housing, said spring operatively associated with said arm and axle to bias said arm and guide means to the limits of a pivotal range.

4. The separator of claim 2, wherein said guide means includes a plurality of aligned triangular plates fixed on said axle and wherein said biasing means comprises the construction and arrangement of said axle with respect to said guide means so that the center of gravity of guide means is located directly above said axle and further wherein said guide means includes an edge member extending parallel to said axle and fixed to said triangular plates.

5. The separator of claim 1, wherein said housing defines a plenum located between said entry passage and said exit passages within which said guide means is contained, said plenum defining a plurality of slots out of which portions of said guide means alternately project for extending the pivotal range of said guide means and providing sustained contact between said guide means and said sheets.

6. An apparatus for segregating alternate individual sheets of paper for example, in a sequential stream, comprising:

a housing defining, an entry passage for said stream of sheets, a pair of separate offset exit passages and a plenum located between said entry and exit passages, said plenum including opposed walls each defining a plurality of slots;

guide means located in said plenum and including a plurality of triangular plates, to engage said sheets, said guide means being mounted in said housing so that said plates align to project from said slots in one or the other of said opposed walls, said guide means to alternately deflect said sheets in said stream into a different one of said exit passages; and bi-stable means for mounting said guide means in said plenum including an axle mounted in bearings so that said guide means may pivot and biasing means for biasing said guide means to the limits of a pivotal range, said bi-stable means, said guide means and said housing being constructed and arranged so that said guide means will assume either one of two stable positions at said limits of pivotal range, said two stable positions directing said sheets into different exit passages and whereby said guide means is actuated to shift between said stable positions by the force exerted on said plates of said guide means by an individual sheet as said sheet passes said guide means into one of said exit passages.

7. The apparatus of claim 6, further including feed means for supplying said stream of sheets into said entry passage of said housing.

* * * * *